US006957551B2

(12) United States Patent
Moeller et al.

(10) Patent No.: US 6,957,551 B2
(45) Date of Patent: Oct. 25, 2005

(54) METHOD FOR PRODUCING AN AIR SEPARATION INSTALLATION

(75) Inventors: Stefan Moeller, Munich (DE); Wolfgang Bader, Ebenhausen (DE)

(73) Assignee: Linde AG, Wiesbaden (DE)

( * ) Notice: Subject to any disclaimer, the term of this patent is extended or adjusted under 35 U.S.C. 154(b) by 10 days.

(21) Appl. No.: 10/344,672

(22) PCT Filed: Aug. 13, 2001

(86) PCT No.: PCT/EP01/09346

§ 371 (c)(1),
(2), (4) Date: Aug. 22, 2003

(87) PCT Pub. No.: WO02/16846

PCT Pub. Date: Feb. 28, 2002

(65) Prior Publication Data

US 2004/0035149 A1 Feb. 26, 2004

(30) Foreign Application Priority Data

Aug. 18, 2000 (DE) ..... 100 40 396
Oct. 19, 2000 (EP) ..... 00122768

(51) Int. Cl.[7] ..... F25J 3/00; F25J 5/00
(52) U.S. Cl. ..... 62/643; 62/902; 62/911
(58) Field of Search ..... 62/643, 902, 905, 62/911, 620

(56) References Cited

U.S. PATENT DOCUMENTS

| | | | | |
|---|---|---|---|---|
| 5,461,871 | A | 10/1995 | Bracque et al. | |
| 5,896,755 | A * | 4/1999 | Wong et al. | 62/643 |
| 5,912,425 | A | 6/1999 | Peyron et al. | |
| 6,128,921 | A * | 10/2000 | Guillard et al. | 62/643 |
| 6,148,637 | A * | 11/2000 | Guillard et al. | 62/643 |
| 6,205,815 | B1 * | 3/2001 | Bruder et al. | 62/643 |
| 6,272,883 | B2 * | 8/2001 | Bruder et al. | 62/643 |
| 6,360,815 | B1 | 3/2002 | Vadrot et al. | |

FOREIGN PATENT DOCUMENTS

| | | |
|---|---|---|
| DE | 2822774 | 11/1979 |
| FR | 2649962 | 1/1991 |
| FR | 2780147 | 12/1999 |

* cited by examiner

*Primary Examiner*—William C. Doerrier
(74) *Attorney, Agent, or Firm*—Millen, White, Zelano & Branigan, P.C.

(57) ABSTRACT

The invention relates to a method for producing an installation for implementing a method for cryogenic air separation, whereby at least one constituent of the air used is obtained as a product by means of a selected method variant. Said installation comprises at least one coldbox in which a module is arranged. The invention is characterized in that several classes are predefined, each class determining the dimensions of the coldbox pertaining thereto, and the coldbox of each class being large enough to hold the module for at least two different product quantity requirements and/or at least two different method variants. A coldbox of a certain class is selected and the module is arranged in the coldbox of said selected class.

17 Claims, No Drawings

METHOD FOR PRODUCING AN AIR SEPARATION INSTALLATION

The invention relates to a process for producing a system for carrying out a low-temperature air separation process in which at least one component of the feed air is obtained as product by means of a selected process variant, the system having at least one coldbox in which there is at least one module.

Low-temperature air separation systems yield large amounts of oxygen, nitrogen, argon and optionally other rare gases by separation of ambient air. Such systems are designed based on customer-dictated product specifications. The customer defines the types of product he desires, for example, oxygen, nitrogen and argon, their respective amounts, pressures and purities, whether the products are to be obtained in gaseous and/or liquid form, and the dynamics of the system when production is shifted and changed.

Using these product specifications, the manufacturer of the system selects a certain air separation system or a certain process variant, the system components required for it, such as machinery and apparatus, instrumentation, automation and control. All of these components must be matched to one another.

In practice, this means that each system must be designed and laid out anew. Here, in addition to customer specifications, numerous physical and production engineering boundary conditions must be observed, such as, for example, allowable pressures, maximum amounts, and ease of manufacture of the required modules. Therefore, design of an air separation system is very complex and expensive.

The object of this invention is to devise a process for producing an air separation system that reduces the complexity that is associated with design, layout and production.

This object is achieved in a process of the initially mentioned type in that several size classes are predefined, one size class fixing the dimensions of the coldbox of this size class and the coldbox of each size class being so large that in the coldbox the module for at least two different product amount requirements and/or at least two different process variants can be accommodated, and that one coldbox of a certain size class is selected and the module is located in the coldbox of the selected size class.

Within the framework of this description, the components of the low-temperature air separation system are conceptually divided into modules, accessories and piping. The modules comprise all components which enable one of the functions specific to air separation. They are especially equipment, such as condensers, compressors, expansion machines and cryogenic pumps, air purification devices, such as, e.g., molecular sieves and adsorbers, heat-exchange devices, such as, e.g., the main heat exchanger, main condenser, head condensers, secondary condensers and supercooling countercurrent heat exchangers, and air separation devices, such as rectification columns. A "cold module" is defined as a module that is provided with thermal insulation, a so-called coldbox.

In the past, the individual modules of an air separation system were selected with consideration of the customer's product specifications and the air conditions prevailing at the installation site of the system and based on other secondary conditions, such as legal regulations and standards. The cold modules, i.e., the modules that must be thermally insulated, and their accessories, individually or combined in groups, were placed in one or more coldboxes that were matched exactly to the dimensions of the modules or the groups of modules.

According to the invention, the dimensions of the coldbox or the coldboxes in which one or more of the modules to be thermally insulated are housed are no longer designed exactly for the modules. Rather, several size classes of coldboxes are predefined so that only a limited number of coldbox sizes is available.

Using the aforementioned criteria such as product specifications, etc., first the modules planned for the low-temperature air separation system to be produced are chosen. Depending on the size of the system, the cold modules that are to be housed in the coldboxes are divided into groups. The groups are divided preferably such that after the module groups are placed in the coldboxes, one or more transportable units result and preferably such that functional units are formed. For example the pressure column, the low-pressure column and the main condenser are combined into a nitrogen-oxygen rectification unit.

According to the modules or module groups to be insulated, then one size class is selected and the modules are placed in a coldbox with the dimensions of the chosen size class. The individual size classes are established beforehand, regardless of the current system designed using customer specifications. Within one size class, a fixed coldbox size is assigned to each module and each module group that arise for the different process variants and system sizes.

The size classification according to the invention will be illustrated using the following example. Five size classes are predefined, within one size class a first coldbox size being established for the pressure column modules, a second coldbox size being established for the low-pressure column module, another coldbox size being established for the argon rectification module and, for example, a fourth coldbox size for the energy exchange module with the main heat exchangers. According to customer wishes, the intended air separation process variant and the other boundary conditions, the size, embodiment, arrangement and combination of individual modules are determined. Here, e.g., a pressure column module with certain dimensions results. By comparison with the predefined size classes, the class to be used is selected, and the coldbox size that has been established in this class for the pressure column module is used. The coldbox sizes in the individual size classes are established such that in spite of the limitation to only five sizes, a host of process variants and product amount requirements for which the pressure column module differs with respect to the size and accessories in each case are covered.

The selected coldbox is thus not matched exactly to the specific process variant and the modules used in the special application with accessories, but only a selection from the limited number of possible coldbox sizes. The selected coldbox is thus at first glance not the optimum solution for insulation of the module used. Generally, therefore, according to the invention, the material costs for the coldbox will be somewhat higher than those of a coldbox that is exactly matched in the conventional manner to the parts that are to be insulated. It has been shown, however, that by the definition of certain size classes according to the invention, savings in engineering can be achieved that exceed the higher material cost and thus overall yield cost advantages.

The individual size classes are chosen such that each size class covers at least two different product amount requirements and/or at least two different process variants. The process variants differ, for example, by the products obtained, the type of product compression, the product pressures, the product purities, the ratio of liquid to gas or the ratio of the amount of oxygen product to the amount of nitrogen product.

Preferably the pressure column, the low-pressure column or the entire nitrogen-oxygen rectification module and the respective accessories are placed in a coldbox that is chosen independently of the type of product compression. At a given product amount both for external compression of the products, i.e., a compression of the gaseous product, and also for internal compression, i.e., for compression of the liquid product with subsequent vaporization of the compressed liquid, the same coldbox size is selected in each case.

The size classes are advantageously chosen furthermore such that the coldbox sizes of the pressure column module, the low-pressure column module or the nitrogen-oxygen rectification module are selected independently of whether a raw argon column and optionally other columns are to be connected to the low-pressure column or not.

Furthermore, it is advantageous to provide the same coldbox sizes for at least two process variants in which products with different pressure or different purities are obtained or for two processes in which the ratio between the gaseous product amount and the liquid product amount varies or for two processes with a different ratio of the amount of product oxygen to the amount of product nitrogen.

It has proven especially advantageous to establish the size classes such that one cold box of one size class is suitable for covering the pertinent modules and their accessories of at least 5, preferably at least 10 different process variants. The coldbox is made here such that each individual one of the process variants, but not necessarily all process variants, can be covered at the same time.

The size classes are selected such that at least two different process variants and/or two different product amount requirements can be covered with one coldbox of one size. Two product amount requirements are regarded as different when the production of the required product amounts has different effects on the embodiment and/or the size and/or the number of required modules and/or their accessories.

The invention has both advantages when all modules are located in exactly one coldbox, and also when there are at least two coldboxes for the modules. In the former case, several size classes for the coldbox are established in which all modules that are to be thermally insulated can be accommodated. Depending on the process variant and the product amount requirement, a certain size class is chosen, the same size class also being suitable for other process variants or product amount requirements. In this case, each size class comprises only a single coldbox size. If the cold modules conversely are distributed among several coldboxes, a certain dimensioning of the corresponding coldbox is established by one size class for each module or each group of modules that are each to be accommodated in its own coldbox. If, for example, all cold modules are divided into an energy exchange module with the heat exchanger, a rectification module with rectification columns and an accessory module with all other components, the dimensions of the three coldboxes corresponding to the above-mentioned modules are dictated by each size class.

When the cold modules are divided among several coldboxes, preferably the same size class is chosen for all coldboxes. Coldboxes of the same size class that are intended for the different modules or module groups are especially preferably provided with defined interfaces. The connection points for the piping, the instrumentation, the electric power supply, etc., are established independently of the specific process variant. Within one size class, not only the dimensions of the coldboxes, but also their connection points are defined. The individual coldboxes with the modules can thus also be easily connected to one another in an analogous manner without additional engineering cost.

To some extent, it is also a good idea to house the different modules of an air separation system in cold boxes that are assigned to different size classes. If, for example, the customer requires only relatively little argon and therefore the maximum possible amount of argon is not to be recovered, a correspondingly smaller argon module is used. In this case, it is useful to select the coldbox for the argon module from a lower size class than the coldboxes for the pressure column and the low-pressure column module or for the oxygen/nitrogen rectification module.

In order to simplify as much as possible the production of systems in which coldboxes of different size classes are combined, it is advantageous to establish fixed interfaces for the piping and other connections not only within one size class regardless of the embodiment of the module to be accommodated in the coldbox, but also to define the interfaces regardless of the size class. Thus, e.g., the location and the type of connection points for the piping are independent of the size of the coldboxes. The connection points for the electrical power supply lines and the instrumentation can be located, for example, always on the side of the coldbox opposite the pipe connections. In other words: the connection points of the coldboxes are chosen such that the connection of the coldboxes among one another or to other components or modules regardless of the size of the coldboxes can always be made identical.

As mentioned, the savings achieved by the invention in the design of the coldboxes are purchased at the cost of slightly increased material consumption due to the coldboxes that are not optimally matched. It has been found that the optimum with respect to costs is achieved when 3 to 10, preferably 4 to 8, especially preferably 4 to 6 size classes are predefined. In this case, the savings are much greater than the costs incurred due to the additional material consumption.

The invention entails advantages especially in large systems for processing of more than 25000 $Nm^3/h$ of air, preferably more than 50000 $Nm^3/h$ of air, since in these systems, the cost for engineering is especially high.

What is claimed is:

1. A process for producing a system for carrying out a low-temperature air separation process in which at least one component of the feed air is obtained as product by means of a selected process variant, the system having exactly one coldbox in which there is at least one module, characterized in that several size classes are predefined, one size class fixing the dimensions of the coldbox of this size class and the coldbox of each size class being so large that in the coldbox the module for at least two different product amount requirements and/or at least two different process variants can be accommodated, and that one coldbox of a certain size class is selected and the module is located in the coldbox of the selected size class.

2. A process for producing a system according to claim 1, wherein 3 to 10 size classes are predefined.

3. A process for producing a system according to claim 1, wherein the system is suitable for processing more than 25000 $Nm^3/h$ of air.

4. A process for producing a system according to claim 1, wherein 4 to 6 size classes are predefined.

5. A process for producing a system according to claim 4, further comprising storing the dimensions of the several size classes of coldboxes, whereby multiple systems having different requirements can be produced on the basis of the different stored classes of the coldboxes.

6. A process for producing a system for carrying out low-temperature air separation process in which at least one component of the feed air is obtained as product by means of a selected process variant, the system having at least one coldbox in which there is at least one module, characterized in that several size classes are predefined, one size class fixing the dimensions of the coldbox of this size class and the coldbox of each size class being so large that in the coldbox the module for at least two different product amount requirements and/or at least two different process variants can be accommodated, and that one coldbox of a certain size class is selected and the module is located in the coldbox of the selected size class, further comprising storing the dimensions of the several size classes of coldboxes, whereby multiple systems having different requirements can be produced on the basis of the different stored classes of the coldboxes.

7. A process for producing a system according to claim 6, wherein the system has at least two coldboxes.

8. A process for producing a system according to claim 6, wherein 3 to 10 size classes are predefined.

9. A process for producing a system according to claim 7, wherein 3 to 10 size classes are predefined.

10. A process for producing a system according to claim 7, wherein 4 to 8 size classes are predefined.

11. A process for producing a system according to claim 7, wherein 4 to 6 size classes are predefined.

12. A process for producing a system according to claim 6, wherein the system is suitable for processing more than 25000 $Nm^3/h$ of air.

13. A process for producing a system according to claim 7, wherein the system is suitable for processing more than 25000 $Nm^3/h$ of air.

14. A process for producing a system according to claim 8, wherein the system is suitable for processing more than 25000 $Nm^3/h$ of air.

15. A process for producing a system according to claim 9, wherein the system is suitable for processing more than 25000 $Nm^3$ of air.

16. A process for producing a system according to claim 6, wherein the system is suitable for processing more than 50000 $Nm^3/h$ of air.

17. A process for producing a system according to claim 2, wherein the system is suitable for processing more than 25000 $Nm^3/h$ of air.

* * * * *

UNITED STATES PATENT AND TRADEMARK OFFICE

CERTIFICATE OF CORRECTION

PATENT NO. : 6,957,551 B2
DATED : October 25, 2005
INVENTOR(S) : Stefan Moeller et al.

It is certified that error appears in the above-identified patent and that said Letters Patent is hereby corrected as shown below:

Column 6,
Line 16, should read -- $Nm^3/h$ of air --.

Signed and Sealed this

Fourteenth Day of February, 2006

JON W. DUDAS
*Director of the United States Patent and Trademark Office*